United States Patent [19]

Cheetham

[11] Patent Number: 4,482,313

[45] Date of Patent: Nov. 13, 1984

[54] GASBURNER SYSTEM

[75] Inventor: Harry A. Cheetham, Broadstone, England

[73] Assignee: Stelrad Group Limited, Oxfordshire, England

[21] Appl. No.: 928,274

[22] Filed: Jul. 26, 1978

[30] Foreign Application Priority Data

Jul. 27, 1977 [GB] United Kingdom ..... 31589/77

[51] Int. Cl.[3] ..... F23N 1/02

[52] U.S. Cl. ..... 431/89; 431/19; 431/329; 431/354; 126/116 A; 239/553

[58] Field of Search ..... 431/328, 329, 354, 89, 431/19, 217; 239/553, 553.3, 592, 593; 126/116 A

[56] References Cited

U.S. PATENT DOCUMENTS

| | | | |
|---|---|---|---|
| 1,186,226 | 6/1916 | Parker | 239/553 |
| 1,431,633 | 10/1922 | Clements | 431/354 |
| 2,274,818 | 3/1942 | Zink | 431/182 |
| 2,746,534 | 5/1956 | Brooks et al. | 431/89 |
| 2,755,851 | 7/1956 | Dow et al. | 239/553 |
| 3,204,683 | 9/1965 | Ruff et al. | 431/329 |
| 3,813,033 | 5/1974 | Caparone | 236/9 R |

FOREIGN PATENT DOCUMENTS

| | | | |
|---|---|---|---|
| 2556635 | 7/1976 | Fed. Rep. of Germany | 431/19 |

*Primary Examiner*—Randall L. Green

*Attorney, Agent, or Firm*—Pearne, Gordon, Sessions, McCoy, Granger & Tilberry

[57] ABSTRACT

A gas burner which consists of a cylindrical duct forming member closed at one end and open at the other end to receive a gas/air mixture under pressure. The member is perforated so that the gas/air mixture flows to the outside of the member where it is burned. The duct is provided with a cone-shaped plug for reducing the volume of the duct from the open end towards the closed end so that a constant velocity of gas/air mixture is maintained within the duct to obtain a uniform static pressure on the outside in the region where the gas/air mixture is burned.

2 Claims, 8 Drawing Figures

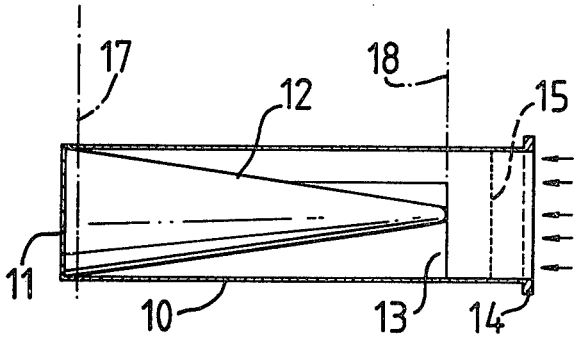
FIG. 1.
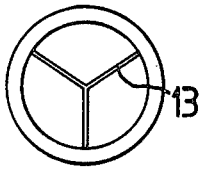
FIG. 2.
FIG. 3.
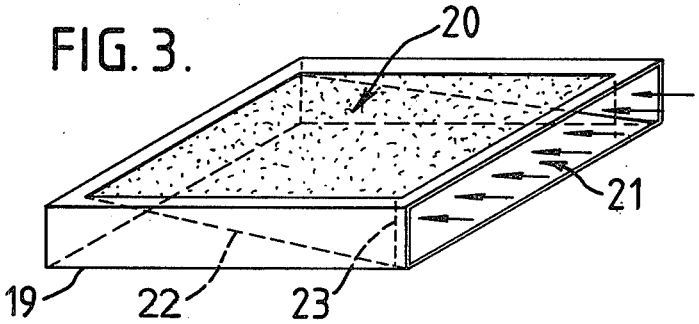
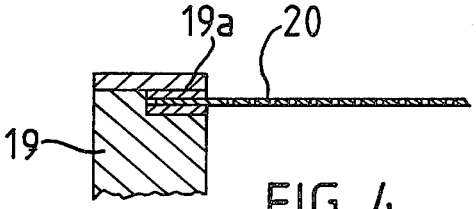
FIG. 4.

GASBURNER SYSTEM

BACKGROUND OF THE INVENTION

This invention relates to a gas burner.

Gas burners are known which consist of a perforated cylindrical member closed at one end and open at the other end to receive a flow of gas and air mixture under pressure. In these known burners the velocity of the mixture within the member is not constant and therefore the static pressure on the outside of the member where the gas/air mixture is burned is not uniform. Consequently the flow of gas/air mixture through the perforations is not uniform and the flame height is not uniform. As the flow of gas/air mixture through the perforations is not uniform and the velocity of the mixture can fall below the flame speed of the gas/air mixture then flash back can occur and an explosion may result.

SUMMARY OF THE INVENTION

This invention relates as aforesaid to a gas burner.

The gas burner according to the present invention can be used in the modular heat exchanger unit which forms the subject matter of my copending U.K. patent application No. 33535/76 and in the heat exchange unit which forms the subject of my copending U.K. patent application No. 4492/77. The gas burner can also be used in other types of heat exchanger plant, e.g. other types of boilers, air heaters, etc.

An object of the invention is to provide a gas burner in which a constant velocity of gas/air mixture is maintained within the member and a uniform static pressure is produced on the outside of the burner where the gas/air mixture is burned.

According to the present invention there is provided a gas burner comprising a cylindrical or rectangular member defining a duct closed at one end and open at the other end, said member having a longitudinally extending perforated wall or wall portion, means for connecting the open end to a source of gas/air mixture under pressure, and means within the member or forming part of the member for gradually reducing the volume of the duct from the open end towards the closed end so that in use of the burner a constant velocity of gas/air mixture is maintained within the duct to obtain a uniform static pressure on the outside of the perforated wall or wall portion where the gas/air mixture is burned.

The duct defining member of the burner is preferably of a perforated sheet metal construction, the size of the perforations preferably being as small as practical to prevent flash back of the flame through the holes. The burner is supplied with a mixture of gas and air in proportions such that the mixture lies within the range of inflammability. The method of supplying the gas/air mixture is particularly important and should be such that a uniform static pressure is obtained on one side of the perforated wall or wall portion; by this means the flow of gas through the holes in the perforated wall or wall portion is uniform and the flame height is thus uniform all over the burner. The velocity of the gas through the holes in the perforated wall or wall portion should be greater than the flame speed of the gas and air mixture being burned. If the flow of gas and air through the holes is not uniform and at some part of the burner the velocity falls below the flame speed of the gas and air mixture flash back will occur and an explosion may result.

In the patent applications referred to above, the perforated sheet is formed into a cylinder and the gas/air mixture burns from the surface of the cylinder.

BRIEF DESCRIPTION OF THE DRAWINGS

To the accomplishment of the foregoing and related ends, the invention then comprises the features hereafter fully described and particularly pointed out in the claims, the following description and annexed drawings setting forth in detail certain illustrative embodiments of the invention, these being indicative however of only some ways in which the principle of the invention may be employed.

In said annexed drawings

FIG. 1 is a longitudinal section through a cylindrical gas burner according to the present invention;

FIG. 2 is an end view taken in the direction of arrow 2 in FIG. 1;

FIG. 3 is a diagrammatic perspective view of a rectangular gas burner constituting another embodiment of the invention;

FIG. 4 is a section showing a detail of FIG. 3;

DESCRIPTION OF THE PREFERRED EMBODIMENTS

Figure 5:
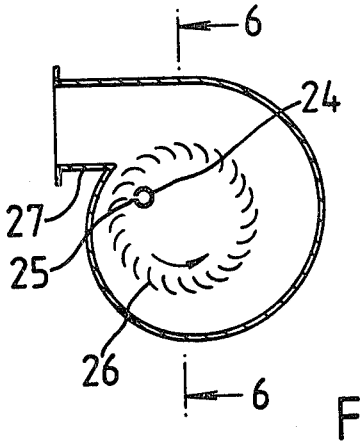
FIG. 5 is a diagrammatic section through a fan and gas supply conduit.
Figure 6:
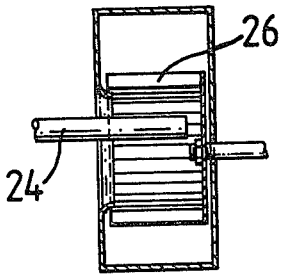
FIG. 6 is a section taken along the line 6—6 of FIG. 5.

In the embodiment illustrated in FIGS. 1 and 2, 10 indicates generally a perforated metal sheet formed into a cylinder closed at one end by a disc 11 and supplied with a gas/air mixture through the other open end. The area of the perforations lies between planes 17 and 18. A hollow plug 12 is provided within the cylinder 10 and is held central by three struts 13. The shape of the plug 12 is arrived at by calculating the velocity of the approaching gas and maintaining this constant along the cylinder 10 allowing for the fact that gas is escaping through the holes in the perforated metal. An approximation to the theoretical shape can be achieved by using a cone which is easier to manufacture. A gauze 15 extends across the cylinder 10 and has sufficient blockage to ensure a substantially uniform velocity profile at plane 18. The cylinder 10 has a radial flange 14 at its open end which supports the burner in position in the heat exchanger and by supporting it at one end only allows the burner to expand axially.

FIG. 3 shows an alternative shape of burner if the flame is required to be substantially flat. The burner consists of a rectangular box 19 one side of which is covered by a perforated metal sheet 20. Gas and air mixture is supplied to the open entrance 21 to the box 19. The uniformity of gas flow through the perforations in the sheet 20 and hence the uniformity of flame height is obtained by the same method described previously, but in this case the plug becomes a suitably shaped plate 22. A gauze 23 can again be used at or near the open entrance 21 to ensure uniformity of velocity profile. If for some reason the flame is not required to be uniform it can be varied by altering the distribution of holes in the perforated plate 20. Means must be made to allow for expansion of the perforated plate 20; one method is to bow the perforated plate 20 slightly. Alternatively the box 19 can be made of a casting or fabrication and the plate 20 held in position by a gasket 19*a* which will allow small movements as shown in FIG. 4. Other shapes of flame can be obtained by using the perforated plate in other modes.

Mixing of the gas and air can conveniently be carried out by using a fan which not only supplies the necessary pressure to overcome the resistance of the perforated plate, the gauzes etc. and the heat exchanger, but also stirs the gas and air together to obtain a uniform mixture.

One method of introducing gas so that the mixture is uniform is shown in FIG. 5. The gas injector pipe 24 is closed at its downstream end, and a slit 25 is cut in the pipe 24 whose length is approximately the same as the depth of the fan runner 26 and whose width is sufficient to allow the gas to be at approximately zero pressure, or very small pressure. The gas pipe 24 is positioned near to the cut-off point of the fan 27, but displaced in the direction of rotation of the fan. The slit 25 is positioned so that the gas discharges between the blades 26 of the fan. Alternatively gas discharge ports can be used instead of a slit 25, such as a series of holes. The fan motor (not shown) may be on either side of the fan 27.

Figure 7:
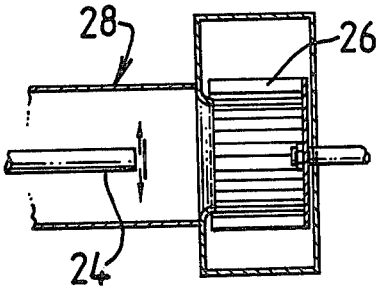
FIG. 7 is a section similar to that of FIG. 6 through a modified fan.

Alternatively the fan 27 may have a duct 28 mounted on the fan entry as shown in FIG. 7. The gas supply pipe 24 is positioned in the fan entry duct 28 and gas is discharged from this pipe 24 so that premixing of the gas and air occurs before the fan blades 26, which then completes the mixing process. The gas discharge area is sufficiently to ensure that the supply pressure is approximately zero or very small.

Alternatively the gas can be introduced directly at the fan inlet. If this is done then a distribution plate must be used to ensure that the gas is mixed with the air prior to being sucked into the fan. The fan completes the mixing process so that a uniform mixture of gas and air emerges from the fan discharge.

Figure 8:
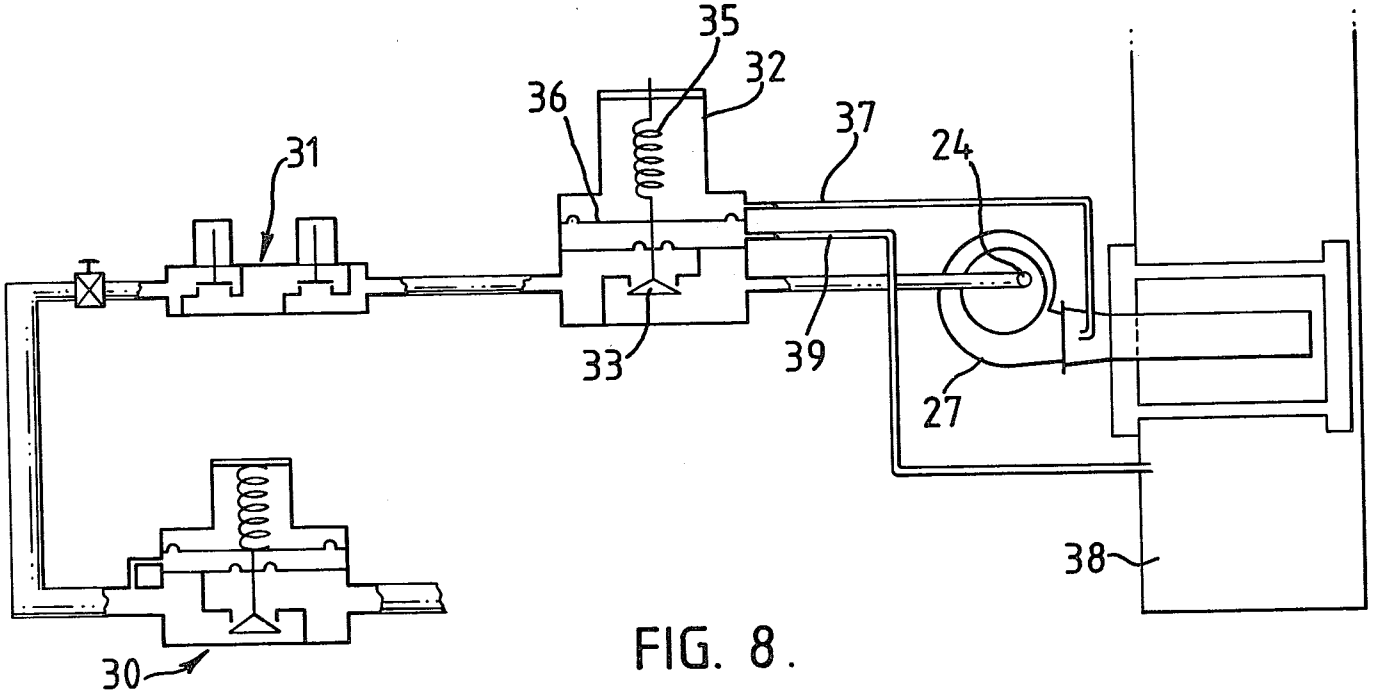
FIG. 8 is a diagrammatic circuit diagram showing the control system for controlling the gas flow to the burner.

The method of control of the gas and air mixture is illustrated in FIG. 8. The gas flows through a governor 30, solenoid valves 31 and a zero governor 32 to the gas injector pipe 24. The rate of flow of gas is controlled by (a) the setting of the governor 30 which gives constant outlet pressure and (b) the position of the valve 33 in the zero governor 32. The position of the valve 33 is itself controlled by the tension of a spring 35 and the pressure on each side of a diaphragm 36. An impulse line 37 senses the total pressure at the fan discharge. Any alteration of air flow caused by, for example, variation of the fan speed caused by voltage fluctuation is immediately sensed and applies change of pressure on the diaphragm 36 which resets the valve 33. Similarly any change in pressure in the boiler 38 is sensed through a line 39 and this also resets the valve 33; thus any change in pressure in the boiler 38 caused by varying draught conditions in the chimney or other causes will alter the gas flow rate.

The impulse line 39 may alternatively be tapped into the heat exchanger module combustion space, in which case it will also detect change of air flow caused by the heat exchange surface becoming dirty and thus increasing the back pressure on the fan.

Using the system described above the air/fuel ratio, or the proportion of gas to air in the supply to the burner is maintained substantially constant independent of external conditions.

I, therefore particularly point out and distinctly claim as my invention:

1. A gas burner comprising a member defining a duct closed at one end and open at the other, said member having a longitudinally extending perforated wall or wall portion, means for connecting the open end to a source of gas/air mixture under pressure, means within the member or forming part of the member for gradually reducing the volume of the duct from the open end toward the closed end so that in use of the burner a constant velocity of gas/air mixture is maintained within the duct to obtain a uniform static pressure on the outside of the perforated wall or wall portion where the gas/air mixture is burned, the open end of said duct being connected to the discharge duct of a fan provided with means for introducing gas under pressure to the air upstream of the fan rotor blades, the gas supply including in series a governor, solenoid-operated flow control valves and a zero governor controlled by pressure at the discharge side of the fan and pressure in the combustion region of the burner.

2. A gas burner comprising a member defining a duct closed at one end and open at the other end, said member having a longitudinally extending perforated wall or wall portion, means for connecting the open end to a source of gas/air mixture under pressure, means within the member or forming part of the member for gradually reducing the volume of the duct from the open end toward the closed end so that in use of the burner a constant velocity of gas/air mixture is maintained within the duct to obtain a uniform static pressure on the outside of the perforated wall or wall portion where the gas/air mixture is burned, said open end being connected to the discharge duct of a fan provided with means for introducing gas under pressure to the air upstream of the fan rotor blades, the gas supply including in series a governor, solenoid-operated flow control valves and a zero governor controlled by pressure at the discharge side of the fan and in a duct housing the burner.

* * * * *